US006491240B1

(12) United States Patent
Veeck et al.

(10) Patent No.: US 6,491,240 B1
(45) Date of Patent: Dec. 10, 2002

(54) PRE-GRINDING SYSTEM FOR REDUCING MATERIAL

(75) Inventors: Richard Irvin Veeck, c/o Veeck Enterprises, Inc. 2032 Divanian Dr., Turlock, CA (US) 95382; George Lazich, Turlock, CA (US)

(73) Assignee: Richard Irvin Veeck, Hilmar, CA (US)

( * ) Notice: Subject to any disclaimer, the term of this patent is extended or adjusted under 35 U.S.C. 154(b) by 0 days.

(21) Appl. No.: 09/494,746

(22) Filed: Jan. 31, 2000

(51) Int. Cl.[7] ..... B02C 13/00; B02C 11/00
(52) U.S. Cl. ..... 241/34; 241/64; 241/186.2
(58) Field of Search ..... 241/34, 63, 64, 241/186.2

(56) References Cited

U.S. PATENT DOCUMENTS

| | | | | | |
|---|---|---|---|---|---|
| 3,952,957 | A | * | 4/1976 | Maillet | 241/185.5 |
| 4,720,051 | A | | 1/1988 | Graveman et al. | 241/186.3 |
| 5,072,985 | A | * | 12/1991 | Yanagimoto et al. | 188/147 |
| 5,427,162 | A | * | 6/1995 | Carter | 144/162.1 |
| 5,772,134 | A | | 6/1998 | Bouldin et al. | 241/79.1 |

* cited by examiner

*Primary Examiner*—William Hong
(74) *Attorney, Agent, or Firm*—Dorsey & Whitney LLP

(57) ABSTRACT

A pre-grinding system for reducing scrape material to chips having a pre-crusher for impact grinding the material, a feed chute for collecting the material for impact grinding, and a hydraulic cylinder section for transferring the material from the feed chute into the pre-crusher. An improvement including a feed chute having an opening providing access into a feed chamber, and a recess in a side wall of the feed chute downwardly extending from the opening in combination with a feed chute cover having a overhang corresponding to the recess, and in which the recess provides horizontal access into the feed chute for viewing into the feed chamber. A further improvement includes a hydraulic actuator and a counterbalance valve for dampening closure of the feed chute cover. A control system is provided for controlling the cover, the gate, and the hydraulic cylinder section, in which the control system moves the gate from a closed-loading position to an opened-operating position only when the cover is in a closed-operating position. The control system only actuates the hydraulic feed cylinder only when the gate is in the opened-operating position. The pre-crusher includes a plurality of identical hammer assemblies. The pre-crusher also includes a rotor disc having a pair of transversely extending secondary wear holes.

8 Claims, 6 Drawing Sheets

PRE-GRINDING SYSTEM FOR REDUCING MATERIAL

BACKGROUND OF THE INVENTION

1. Field of the Invention

This invention relates to a new and improved system for reducing materials to a smaller size. More particularly, it relates to a large-scale pre-grinding system for reducing rigid PVC pipe and other plastic materials for re-cycling.

2. Description of Related Art

Machines for reducing scrap material of the type including a pre-grinding system are known. A pre-grinding system may include a feed chute for receiving scrap material, a pre-grinder for processing the scrap material, a hydraulic cylinder unit for moving the scrap material from the feed chute into the pre-grinder, and other components suitable for handling and processing scrap material. For example, an exemplary pre-grinding system manufactured and sold by MILLER MANUFACTURING of Turlock, Calif. includes a MILLER PL 40 Pre-Grinder in combination with a MILLER PL2340 Feed Chute and a hydraulic cylinder unit. This pre-grinding system provides a high production, minimal maintenance mill capable of pre-grinding PVC pipe scrap for processing to a reusable powder form. This and other conventional systems are limited to processing PVC pipe with a maximum diameter of 36 inches. The present invention processes larger size pipe.

Conventional pre-grinding systems are limited in size due to the impracticability of merely increasing the dimensions of such systems. For example, increasing the size of the feed chute of conventional pre-grinding systems is undesirable because an operator would need to climb upon an external wall of the feed chute to view within a feed chamber of the feed chute. Merely increasing the size of a conventional pre-grinding system would also require the operator to climb upon the external wall to load materials into the feed chamber, increasing the likelihood that an operator will slip and fall into the feed chute. Furthermore, simply increasing the size of the feed chute would necessarily increase the size of feed chute covers. As such doors are typically made of ½" steel plate, increasing the dimensions of the doors would result in larger and heavier doors which would be unwieldy and inherently dangerous for the operator to control.

Conventional pre-grinders use rotor assemblies having a combination of single impact hammers and double impact hammers. For example, the rotor assembly of the prior art pre-grinders carried both single impact hammers having a single impact surface and double impact hammers having two fork-like impact surfaces. The combination of single and double impact hammers allows the single hammer to reduce any scrap material which the double hammer misses, particularly the area of scrap material which extends between the fork-like impact surfaces. A disadvantage of such prior-art machines is that two distinct types of hammers are necessary to design, manufacture, and inventory, which leads to increased costs of manufacturing, maintaining and repairing conventional pre-grinders.

Further, increasing the size of prior art pre-grinders by increasing the diameter of the rotor is unfeasible due to the difficulty in dynamically balancing the heavy mass of the rotor. Increasing the disc diameter of the rotors increases the dynamic loads upon the rotors, which disadvantageously increases wear-and-tear on prior art systems. In particular, the life span of a conventional rotor is limited because disc mounting holes for supporting the hammers wear, which hampers and/or prevents dynamic balancing of the rotor.

SUMMARY OF THE INVENTION

The pre-grinding system of the present invention overcomes the disadvantages of prior pre-grinder system systems discussed above. The pre-grinding system of the present invention reduces scrap materials such as PVC pipe and other rigid materials to chips, for example to chips measuring two inches or less. The pre-grinder system includes a pre-crusher for impact grinding the material, a feed chute for collecting the material, and a hydraulic cylinder section for transferring the material from the feed chute into the pre-crusher. One aspect of the present invention is directed to a feed chute trough having a feed chamber, an opening providing access into the feed chamber, and a recess downwardly extending from the opening, a feed chute cover pivotally connected to the feed chute trough and having an overhang corresponding to the recess which provides horizontal access into the feed chute for viewing the feed chamber.

Another aspect of the present invention is directed to a pre-grinding system including a feed chute trough, a feed chute cover pivotally connected to the feed chute trough, a hydraulic actuator for opening and closing the feed chute cover, and a counterbalance valve for dampening closure of the feed chute cover.

Another aspect of the present invention is directed to a pre-grinding system including a chamber, a cover for closing the chamber having an opened-loading position and a closed-operating position, and a gate providing access from the chamber into a pre-crusher, the gate having an opened-operating position and a closed-loading position, a hydraulic feed cylinder section for transferring the material from the feed chute into the pre-crusher, and a control system for controlling the cover, the gate, and the hydraulic cylinder section, in which the control system moves the gate from the closed-loading position to the opened-operating position only when the cover is in the closed-operating position.

Another aspect of the present invention is directed to a pre-crusher including a rotor assembly rotatably mounted to a housing of the pre-crusher, a first hammer pin transversely mounted on the rotor, a second hammer pin transversely mounted on the rotor, a plurality of identical hammer assemblies, each hammer assembly having a single impact portion. A single hammer assembly is rotatably mounted on the first hammer pin and a pair of hammer assemblies are rotatably mounted on the second hammer pin.

Yet another aspect of the present invention is directed to a pre-crusher including a rotor assembly having at least one disc, the disc having at least a pair of transversely extending primary holes for positioning a respective impact hammer pin, the pair of primary holes being diametrically opposed, the disc having at least a pair of transversely extending secondary wear holes, the pair of secondary wear holes diametrically opposed from one another and radially spaced between the primary holes.

It is an object of the present invention to provide a large feed chute which reduces or eliminates the need to cut pipe or scrap materials to a particular length before placing it into the pre-grinding system.

It is an object of the present invention to promote operator safety and increase machine life by dampening closure of a feed chamber cover.

It is a further object of the present invention to enhance safety of the operator by completely isolating the operator from the pre-crusher and the feed chamber by using a sequential control system which coordinates opening and closing of the feed chamber cover and a pre-crusher gate.

It is a further object of the present invention to provide a pre-grinding system with an interlocked hydraulically safety system in combination with a pre-crusher rotor assembly running at a substantially constant velocity during operation.

It is a further object of the present invention to efficiently and effectively reduce scrap material such as large diameter PVC pipe and other materials to chips with a single pass through the pre-crusher.

It is yet a further object of the present invention to increase the life span of a rotor assembly of the pre-crusher by providing secondary mounting holes for hammer pins of the rotor assembly.

The accompanying drawings, which are incorporated in and form a part of this specification, illustrate embodiments of the invention and, together with the description, serve to explain the principles of the invention:

BRIEF DESCRIPTION THE DRAWINGS

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
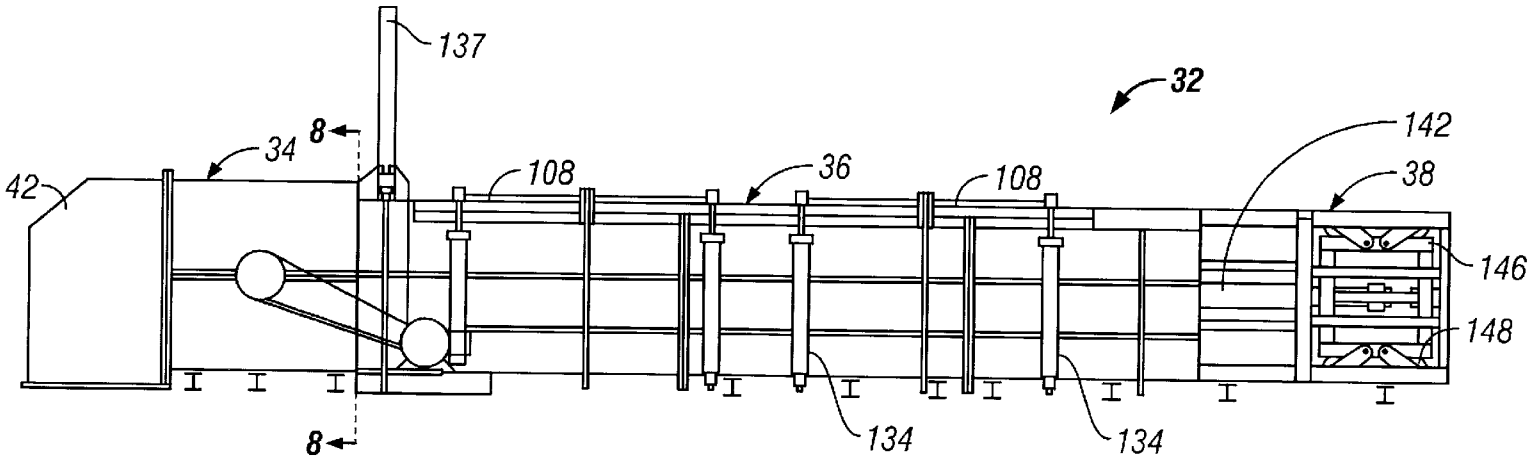
FIG. 1 is a side elevational view of a pre-grinding system in accordance with the present invention.
Figure 3:
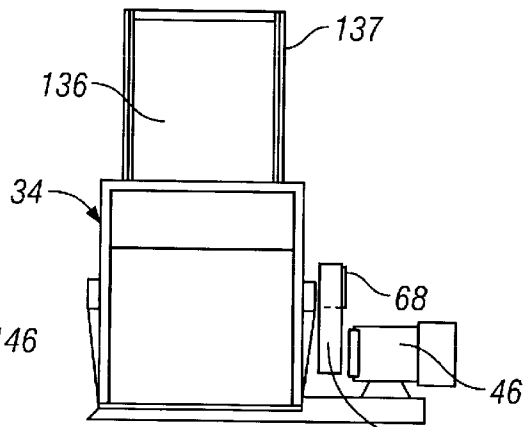
FIG. 3 is a front elevational view of the pre-grinding system.
Figure 2:
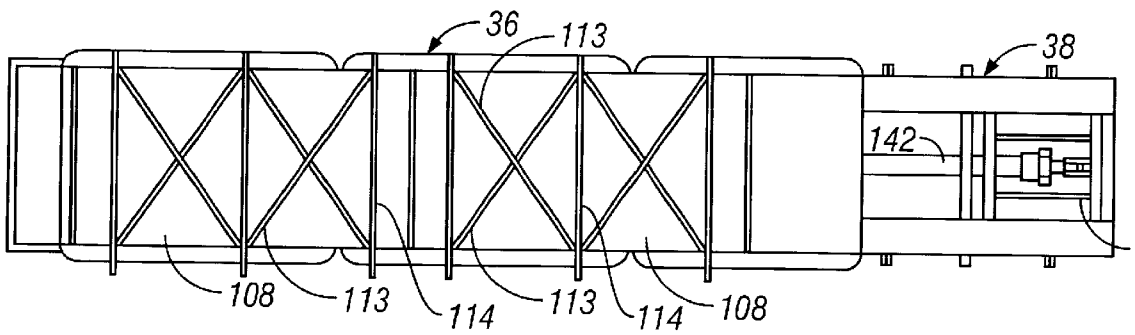
FIG. 2 is a plan view of the pre-grinding system.

The present invention is directed to a pre-grinding system for reducing materials to a smaller size. For example, a pre-grinding system in accordance with the present invention is used for processing PVC pipe scrap into chip form which may subsequently be processed to a fine reusable powdered form. In particular, a pre-grinding system 32 includes a pre-grinder or pre-crusher 34, a feed chute 36, and a hydraulic cylinder section 38, as shown in FIGS. 1–3. Pre-grinding system 32 is manufactured primarily with ½ inch plate steel, ½ inch stock steel and 1½ inch stock steel. Such construction provides a sturdy design leading to a long life span of the pre-grinder system. One skilled in the art should recognize that other materials, such as steel alloys and composite materials, may also be used to fabricate the various components of the system.

Pre-grinding system 32 is designed to reduce lengths of heavy wall pressure pipe, as well as other rigid PVC scrap such as siding and window profiles. Feed chute 36 of the present invention is dimensioned to accept entire lengths of pipe up to approximately six feet in diameter to chips. This enables pre-grinding system 32 to process material into chip form at the rate of up to 15,000 pounds per hour. Such chips, in turn, may then be subsequently processed by a pulverizer (not shown) to a fine reusable powder as noted above.

In accordance with the present invention, PVC scrap and other materials are loaded into feed chute 36. Hydraulic section 38 pushes the materials toward and into pre-crusher 34 for pre-grinding or pre-crushing the material before it is processed by the pulverizer (not shown but well understood in the art). Referring to FIGS. 1 and 2, hydraulic section 38 is actuated to push any materials loaded in feed chute 36 toward the left and into pre-crusher 34. Pre-crusher 34 reduces the materials into chips which are discharged through a discharge shroud 42 to be further processed by the pulverizer.

Figure 5:
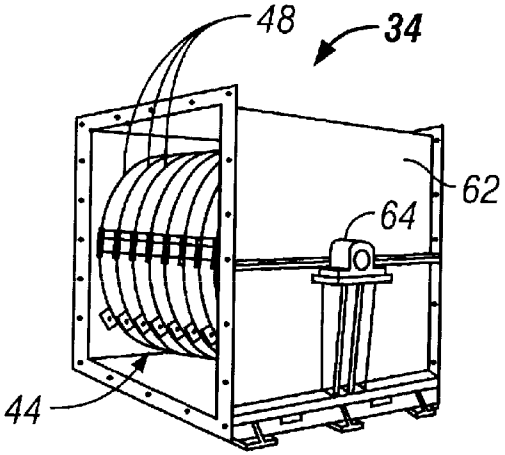
FIG. 5 is a front perspective view of a pre-crusher in accordance with the present invention.

Pre-crusher 34 reduces large pieces of material to chips by impact grinding. FIG. 5 shows pre-crusher 34 including a rotor assembly 44 which is driven by any well known driving means. For example and as shown in FIGS. 2 and 3, rotor assembly 44 may be driven by an electric rotor assembly motor 46. Preferably, the motor is rated at approximately 200 horsepower for speeds up to approximately 1800 RPM, however, one should appreciate motors having other horsepower and speed ratings may be used. Rotor assembly motor 46 drives rotor assembly 44 at a suitable speed which is not so fast as to burn and plasticize PVC materials as they are ground, but not so slow as to prohibit impact grinding of the materials. Preferably, rotor assembly motor 46 will drive rotor assembly 44 at a rate of approximately 550 RPM. One should appreciate, however, that the optimal rotational speed of the rotor assembly will depend upon the actual dimensions of the rotor assembly. Due to its size and inherent inertial forces, pre-crusher 34 is configured to maintain rotor assembly 44 at a substantially constant rotational speed. For example, rotation of rotor assembly 44 will be brought up to speed at the beginning of a shift and will rotate at a substantially constant rate until the end of the shift when the machinery is powered-down. In fact, rotor assembly 44 may maintain a substantially constant speed twenty-four hours a day in case it is desired to operate the machinery around the clock. Several features of the present invention are designed to minimize loads upon rotor assembly 44 and rotor assembly motor 46 and promote overall safety of the pre-grinding system.

Figure 11:
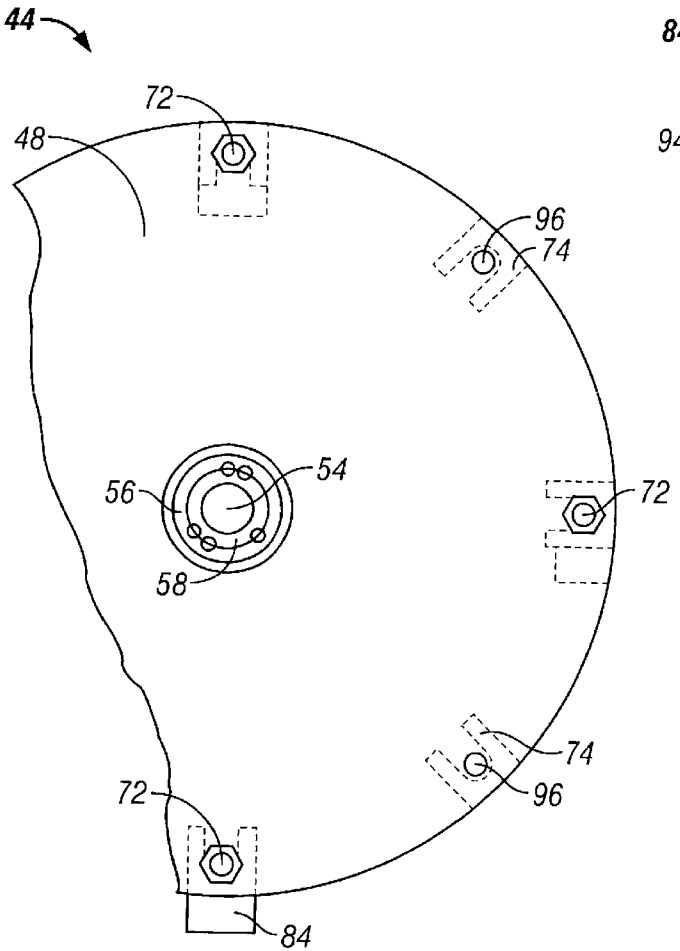
FIG. 11 is a partial front view of the rotor and hammer assembly shown in FIG. 8.
Figure 10:
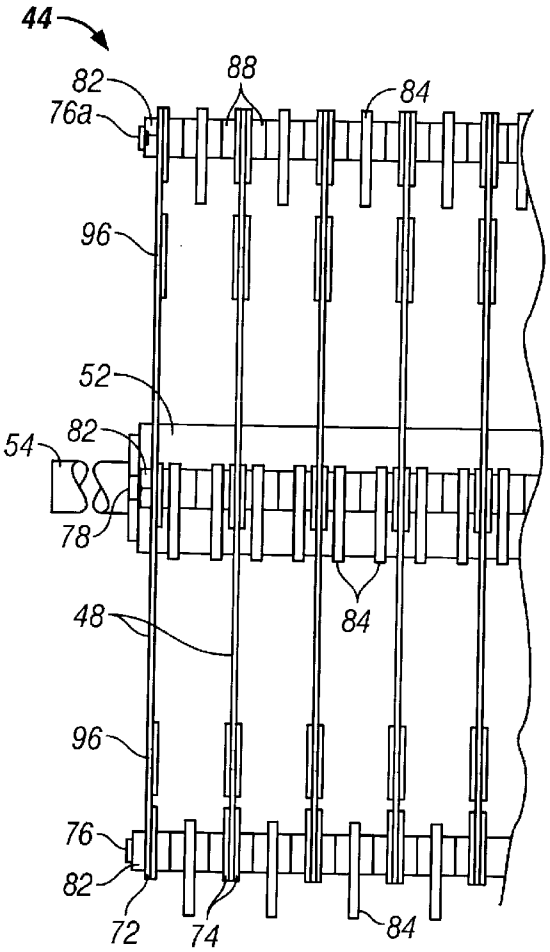
FIG. 10 is a partial side view of the rotor and hammer assembly shown in FIG. 8.

As most clearly shown in FIGS. 10 and 11, rotor assembly 44 includes several annular rotor discs 48 mounted in parallel on rotor tube 52. Rotor tube 52 is mounted upon a rotor shaft 54 by a conventional hub 56 and bushing 58. For example, a TAPER-LOCK weld-on hub may be utilized in combination with a TAPER-LOCK keyway-type bushing, both manufactured by DODGE located in Greenville, S.C., to affix rotor tube 52 to rotor shaft 54. Rotor shaft 54 is provided with a keyway (not shown) on the power-side of rotor shaft 54 for driving engagement thereof. One of ordinary skill in the art should appreciate that an additional keyway may also be provided on the non-driven bearing side of rotor shaft 54. Alternatively, one of ordinary skill in the art should appreciate that suitable means other than a keyway may be utilized to rotationally affix the rotor assembly to rotor shaft 54.

Figure 9:
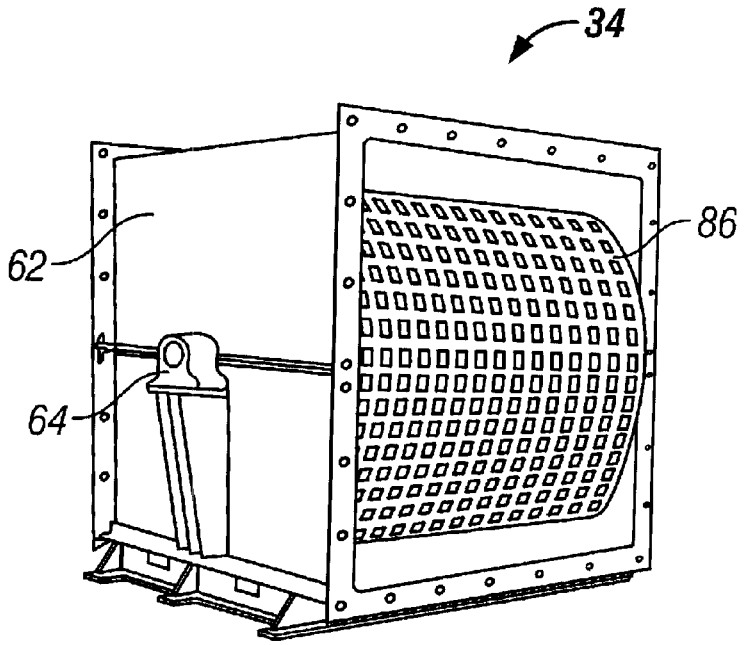
FIG. 9 is a rear perspective view of the pre-crusher shown in FIG. 5.

Each end of rotor shaft 54 is rotatably supported by a side housing 62 of pre-crusher 34 by suitable means, such as a rotor shaft bearing unit 64 as shown in FIG. 9. Rotor shaft 54 is also operably connected to the driving means by a suitable transmission means. For example, rotor shaft 54 may be directly or indirectly coupled to rotor assembly motor 46 by one or more driving belts 66 operably trained around a rotor drive pulley 68, as shown in FIG. 2.

Referring now to FIGS. 10 and 11, rotor discs 48 are provided with a plurality of rotor disc through-holes 72. For reasons discussed in greater detail below, each rotor disc 48 of the present invention preferably has at least eight substantially equally and radially spaced apart through-holes. Each through-hole 72 is reinforced with a rotor doubler or reinforcing plate 74 Reinforcing plates 74 may be U-shaped to provide increased rotor assembly strength while minimizing weight. One should appreciate that other shapes may also be used. For example, the reinforcing plates may include an annular ring instead of a U-shaped plate.

Through-holes 72 of each rotor disc 48 are aligned with the respective through-holes of each adjacent rotor disc 48. Hammer pins 76, 78 are received by respective through-holes 72 of each rotor disc 48 and extend transversely across rotor assembly 44 through each rotor disc 48 of rotor assembly 44. Hammer pins 76, 78 are fixed in place by a hammer jam nut 82, which in turn is locked in place with suitable means such as a set screw (not shown). At least one discrete hammer assembly 84 having a single impact surface is rotatably mounted on a first hammer pin 76 between each adjacent rotor disc 48 and equally spaced between the discs providing a first single hammer configuration. Preferably, two discrete hammer assemblies 84 are mounted on an adjacent second hammer pin 78 between each adjacent rotor disc 48 providing a second double hammer configuration.

As is shown in FIG. 10, the alternating first and second hammer assembly configurations align the one discrete hammer assembly 84 mounted on first hammer pin 76 between the two discrete hammer assemblies 84 mounted on second hammer pin 78 thus providing an impact area that substantially covers the distance between adjacent rotor discs 48. Such hammer assembly spacing provides an impact grinder which efficiently crushes large pieces of PVC material to small chips despite the relatively significant transverse distance between adjacent rotor discs 48. For example, large pieces of PVC material measuring six feet in diameter may be reduced to chips measuring less than three inches in a single pass through rotor assembly 44 of pre-crusher 34. As shown in FIG. 9, pre-crusher 34 includes a cut screen 86 mounted toward the front thereof to prevent larger chips from exiting pre-crusher 34 until they have been reduced to the proper size.

Preferably, each hammer pin 76, 78 is diametrically opposed by a corresponding hammer pin, for example, hammer pins 76*a* (FIG. 10) and 78*a* (not shown). Hammer pins 76*a*, 78*a* have alternate single and double hammer configurations in a similar manner as hammer pins 76, 78 discussed above. For example and referring to FIG. 10, hammer pin 76, which has a single hammer 84 mounted thereon between adjacent rotor discs 48, is diametrically opposed from hammer pin 76*a* which has a corresponding single hammer configuration. Such diametrical spacing of hammer pins and the corresponding hammers assists in counterbalancing the rotor assembly.

Figure 12:
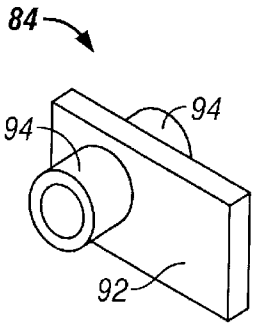
FIG. 12 is a perspective view of a hammer in accordance with the present invention.

Each hammer assembly 84 includes a single impact portion 92 which is flanked by opposing integral spacer portions 94 as shown in FIG. 12. Referring again to FIG. 10, a pair of discrete hammer assemblies 84 are provided on hammer pin 78 between adjacent rotor discs 48 and a single discrete hammer assemblies 84 is provided on hammer pin 76 between adjacent rotor discs 48. Hammer pin spacers 88 are provided on hammer pin 76 to equally space the single discrete hammer assembly 84 from adjacent rotor discs 48 thus providing impact grinding coverage of the area between the pairs of discrete hammer assemblies 84 mounted on hammer pin 78. In accordance with the present invention, the configuration utilizing a discrete hammer assembly, i.e., a single hammer assembly design, allows one discrete hammer assembly to be used in both a single hammer configuration or in a double hammer configuration.

It is noted that prior art devices utilize double hammers in combination with single hammers in order to provide impact coverage similar to that of the present invention. In particular, prior art devices utilize double hammers which include two impact portions having a fork-like configuration in combination with single hammers which include one impact portion in order substantially covers the distance between adjacent rotor discs 48. In contrast, the present invention requires only one design of a hammer assembly and thus provides a simple single and inexpensive design. The cost of designing and manufacturing different parts is lessened, and the need for a greater inventory of replacement parts is obviated because only one type of hammer assembly is necessary.

As noted above, each rotor disc 48 of the present invention is preferably provided with eight through-holes. Four primary through-holes 72 each receives a corresponding hammer pin 76, 76*a*, 78, etc. Preferably, an additional set of through-holes is provided such as wear-holes or secondary through-holes 96. The secondary set of through-holes 96 are equal in number to the number of the hammer pins in the same manner as the primary set of through-holes 72. The additional set of wear-holes or secondary through-holes 96 extends the life of rotor assembly 44 by providing an additional set of holes to receive the hammer pins once the first set of through-holes 72 wear due to the demands of constant high rotational velocity coupled with impact grinding. Once the first set of through-holes 72 is substantially worn and such wear affects the performance of rotor assembly, for example once it is economically unfeasible or impossible to properly balance rotor assembly 44, hammer pins 76, 78, 78*a*, corresponding hammer assemblies 84 and hammer pin spacers 88 may be removed from primary through-holes 72 and reinstalled in the secondary through-holes 96. Accordingly, the secondary through-holes 96 effectively double the life span of rotor assembly 44. One should recognize that yet additional sets of through-holes may also be provided with similar benefits thus further extending the life span of rotor assembly 44.

Referring now to FIGS. 1–4, feed chute 36 includes a feed chamber 98 having a feed chute trough 102 into which PVC and other materials are placed for processing by pre-crusher 34. Chute trough 102 is reinforced by various feed chute trough reinforcing flanges 112. Feed chute trough 102 of feed chamber 98 also serves as a guide for reciprocal motion of platen 104 and platen carriage assembly 106 within feed chute trough 102. Platen 104 pushes the PVC and other materials which are loaded in the feed chamber 98 longitudinally into pre-crusher 34. Feed chamber 98 is enclosed during operation by a pair of hydraulically actuated feed chamber covers 108. Due to the substantial size and weight of the covers necessary for the present invention at least two covers are provided to access feed chamber 98 for loading. Additional covers may be used as required. Chamber covers 108 include lid reinforcers 113 and lid arm flanges 114 to appropriately stiffen and strengthen the doors. Chamber covers 108 also include an overhang 116 which corresponds in shape to a recess 118 provided in a side wall 122 of feed chute 36. Recess 118 promotes safety in that it provides an opening which allows an operator to view into feed chamber 98 without the assistance of a ladder, step or other means to elevate oneself to view into feed chamber 98. Recess 118 further promotes safety because it eliminates the need or tendency for an operator to scale front side wall 122 while the system is operating.

Figure 6:
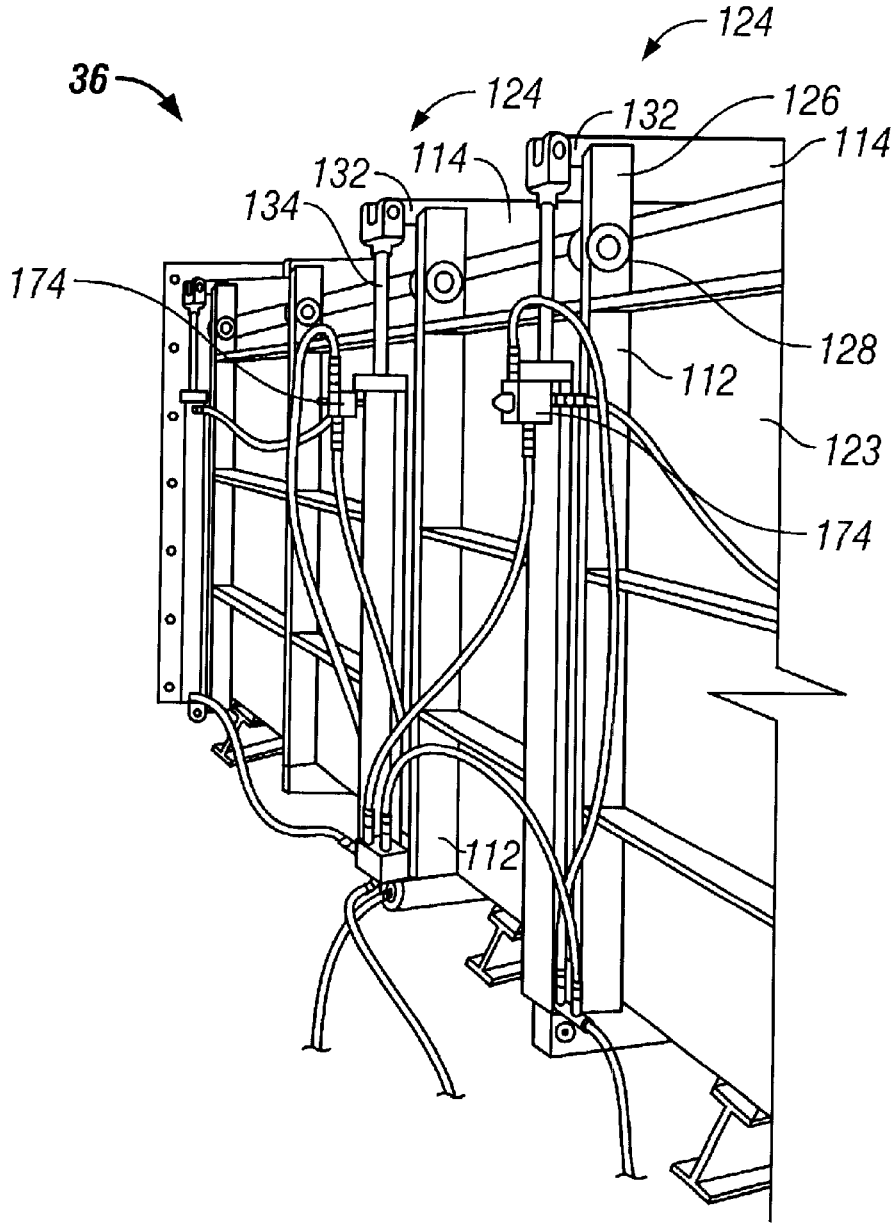
FIG. 6 is an enlarged perspective view of a plurality of feed chute cover cylinders for controlling chamber covers of the feed chute in accordance with the present invention.

As shown in FIG. 6, each chamber cover 108 is pivotally attached to feed chute trough 102 by at least one hinge assembly 124. Preferably two hinge assemblies 124 are provided for each chamber cover 108. Each hinge assembly 124 includes an upper hinge half 126 mounted to a lid arm flange 114 on chamber cover 108. Upper hinge half 126 is pivotally connected to a lower hinge half 128 which is rigidly affixed to a vertically extending feed chute flange 112 on rear side wall 123. Upper hinge half 126 is further provided with an outwardly extending horizontal lever arm 132. Preferably, lever arm 132 is integrally formed with a corresponding lid arm flange 114. Hinge lever arm 132 is operatively attached to a double acting hydraulic chamber cover cylinder 134 for opening and closing chamber covers (not shown in FIG. 6). Hinge lever arm 132 has a relatively short length whereby hydraulic cover cylinder 134 maintains an orientation that is substantially parallel and proximate to rear side wall 123 of feed chute 36 which is located opposite to feed chute recess 118 in front side wall 122 shown in FIG. 4.

Figure 4:
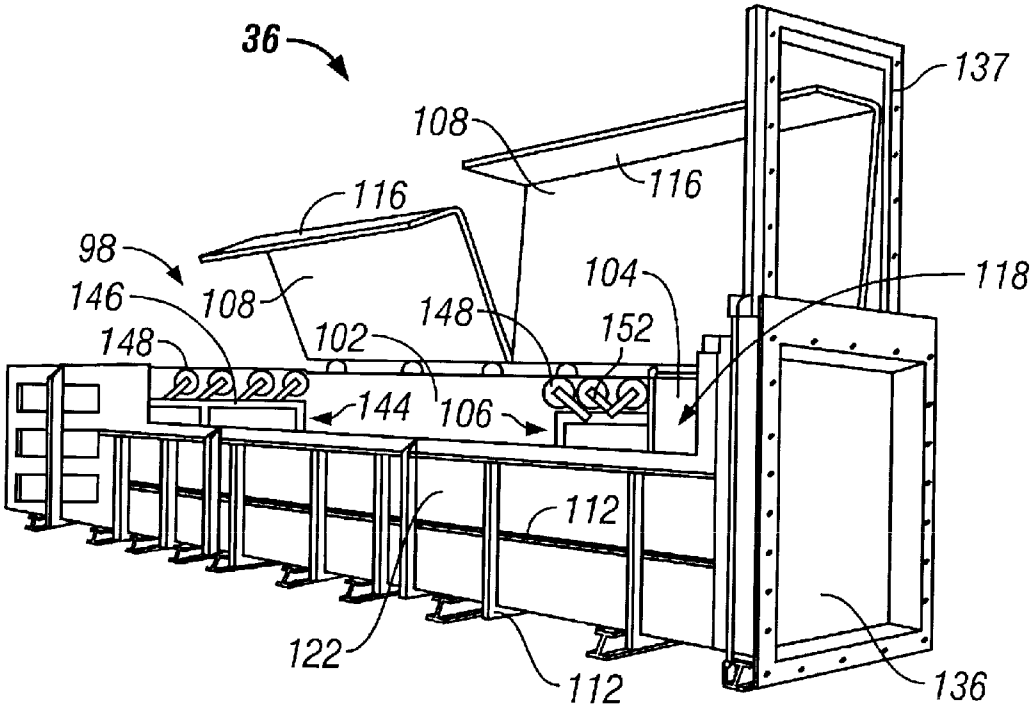
FIG. 4 is a perspective view of a hydraulic cylinder section and a feed chute in accordance with the present invention.

Feed chute 36 also includes a guillotine door or vertical gate 136 mounted on an forward portion thereof adjacent pre-crusher 34. Gate 136 is mounted within a gate guide 137 having gate slides which extend upwardly from a forward portion of feed chute 36. Gate 136 has a lower loading position, as shown in FIG. 4, and an upper operating position. When gate 136 is in the loading position, the gate is lowered, thereby closing feed chamber 98 from pre-crusher 34. Once chamber covers 108 are closed, gate 136 may be raised to an upper operating position. Feed chamber 98 opens to pre-crusher 34 when gate 136 is in its upper operating position.

Chamber covers 108 and gate 136 are hydraulically and sequentially operated by a hydraulic system 138 (FIG. 7) which also controls operation of hydraulic cylinder section 38 and pre-crusher 34, as discussed in greater detail below.

Again referring to FIGS. 1–4, pre-grinding system 32 includes hydraulic cylinder section 38 for moving PVC and other materials from feed chute 36 into pre-crusher 34. In the preferred embodiment, hydraulic cylinder section 38 preferably includes a horizontally disposed three stage hydraulic ram or feed cylinder 142. However, other types of hydraulic cylinder maybe used such as a single or dual stage feed cylinder. Feed cylinder 142 is attached at one end to the rear end of hydraulic cylinder section 38 as seen in FIG. 1. Feed cylinder 142 is also attached to and supported by feed cylinder carriage assembly 144. Feed cylinder carriage assembly 144 includes a feed cylinder carriage frame 146 which is supported and guided by a plurality of feed cylinder carriage wheels 148. Feed cylinder carriage 144 reciprocates horizontally through feed cylinder trough 102 of hydraulic cylinder section 38. One skilled in the art would recognize that a plurality of feed cylinder carriage frames may be utilized depending upon the size and weight of the hydraulic feed cylinder.

Feed cylinder 142 is also attached to platen 104. Platen 104 is a large vertically disposed plate having a surface area which is complementary to the cross-section of feed chute trough 102. Platen 104 is substantially perpendicularly disposed to feed cylinder 142 as well as feed chute 36. Extension of feed cylinder 142 causes platen 104 to translate horizontally through feed chute trough 102 and push any PVC or other materials located in feed chute 36 leftward, as viewed in FIG. 1, toward and into pre-crusher 34.

Platen 104 is supported by a platen carriage assembly 106 in a manner similar to feed cylinder carriage assembly 144 noted above. Platen carriage assembly 106 is supported by a plurality of platen carriage wheels 148. Platen carriage wheels 148 may have a flat profile or a tapered profile in order to reduce rolling resistance. Platen carriage wheels 148 are preferably mounted on platen carriage assembly 106 by respective platen wheel forks 152. Adjusting screws (not shown) may be provided to adjust the position of platen carriage wheels 148 relative to the platen carriage assembly 106 to properly guide it through feed chute trough 102.

Figure 7:
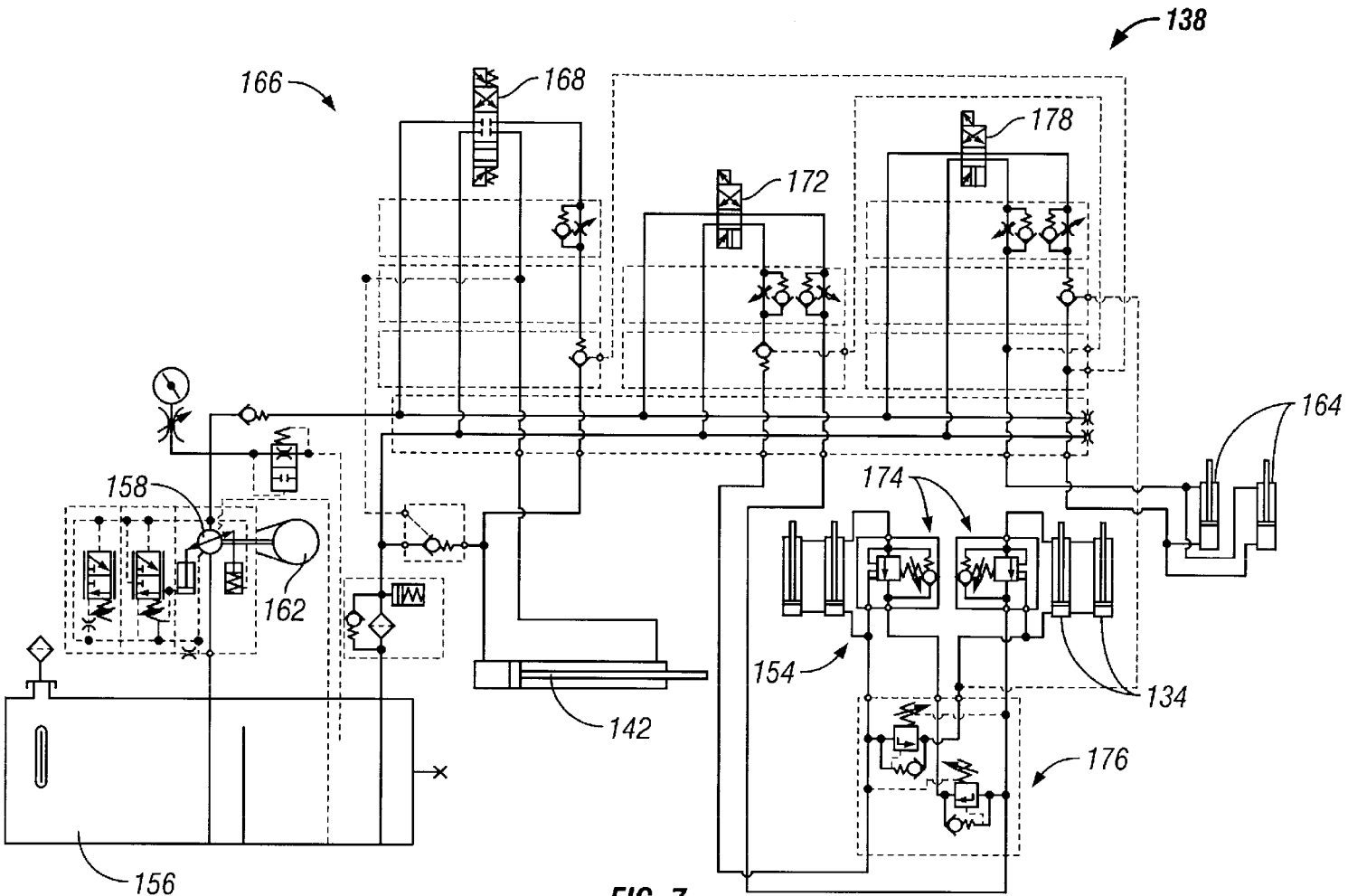
FIG. 7 is a schematic view of a hydraulic system in accordance with the present invention.
Figure 8:
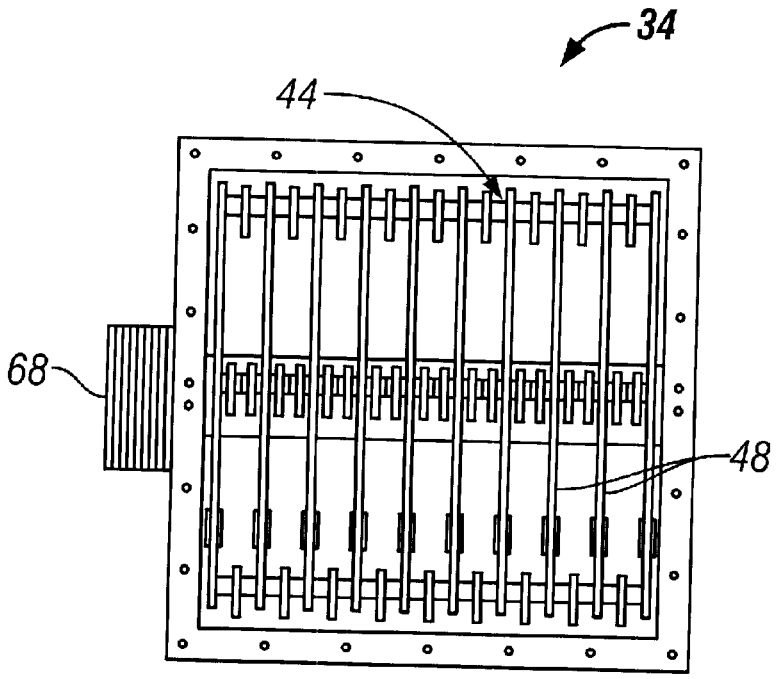
FIG. 8 is a rear view of the pre-crusher showing a rotor and hammer assembly in accordance with,e present invention taken along line 8—8 of FIG. 1.

As noted above, chamber covers 108, gate 136, and hydraulic feed cylinder section 38 are all hydraulically operated by hydraulic system 138 which is shown schematically in FIG. 7. In particular, once feed chute 36 is loaded with PVC pipe or other materials for pre-grinding, and before pre-crusher 34 can be operated, chamber covers 108 are lowered into a closed operating position, as shown in FIG. 1. Due to the size and weight of chamber covers 108, hydraulic system 138 includes a hydraulic damping system 154 to dampen closure of chamber covers 108, as shown in FIG. 7 and discussed in detail below.

Referring to FIG. 7, hydraulic system 138 includes a hydraulic reservoir 156, a hydraulic piston pump 158, and a pump motor 162 for supplying a working pressure of hydraulic fluid to the system. The pressure of hydraulic fluid in hydraulic system 138 may be monitored by a 0–3000 pounds-per-square-inch stem mount gauge or any other well known means. Hydraulic system 138 controls hydraulic fluid flow to feed cylinder 142, cover cylinder 134, and a gate cylinder 164.

Hydraulic system 138 of the present invention preferably includes a three-stage feed cylinder manifold 166 for actuating and controlling the three-stage feed cylinder 142, as shown in FIG. 7. A feed cylinder flow control valve or feed control valve 168 is also provided for controlling the three-stage feed cylinder 142. Feed control valve 168 is a feedback controller which is dependent upon the loads imposed upon pre-crusher 34. Loads upon pre-crusher 34 are monitored in a conventional manner such as measuring the amperage of the electric motor drivingly connected to rotor assembly 44. Feed control valve 168 reduces or prohibits fluid flow to feed cylinder 142 in response to a load signal when the loads upon pre-crusher 34 exceed a predetermined amount due to excess PVC or materials entering pre-crusher 34 too quickly. When the load upon pre-crusher 34 again falls to an acceptable level, feed control valve 168 resumes fluid flow to feed cylinder 142. Feed control valve 168 operates to minimize loads on pre-crusher 34 thus minimizing wear on pre-grinding system 32 and enhancing safety.

Hydraulic system 138 also controls at least one cover cylinder 134 for opening and closing each chamber cover 108. Cover cylinder 134 is a double-acting hydraulic cylinder which is actuated and controlled by a chamber cover control spool valve or cover valve 172. Preferably, each cover 108 is provided with a pair of chamber cover cylinders 134, however, one should recognize that additional cylinder may also be used. Alternatively, one skilled in the art would recognize that pairs of single action hydraulic cylinders may be used in place of each double acting hydraulic cylinder.

Due to the substantial size and weight of chamber covers 108, hydraulic system 138 is further provided with a chamber cover counterbalance valve 174 fluidly connected to each cover cylinder 134. A respective counterbalance valve 174 provides a throttling action as hydraulic fluid exits each respective cover cylinder 134 as covers 108 are closed thereby dampening the covers upon closure thereof. Counterbalance valves 174 increase the life span of pre-grinding system 32 by minimizing impact of heavy chamber covers 108 against feed chute trough 102. The throttling action of counterbalance valves 174 may be manually adjustable to optimize dampening of chamber covers 108. Alternatively, an automatically adjustable counterbalance valve maybe provided to adjust dampening based on feedback variables such as angular closure speed of the covers with respect to the feed chute trough.

The hydraulic system of the present invention further includes a dual sequence valve 101 for sequentially closing each cover 108. Due to the substantial size and weight of each cover 108, closing one cover at a time further minimizes impact of chamber covers 108 against feed chute 36 and minimizes the load on hydraulic system 138. In accordance with the present invention, dual sequence valve 176 actuates one set of cover cylinders 134 to close one cover 108 before a second pair of cover cylinders 134 is actuated to close a respective cover 108. In accordance with the present invention, triple and other multi-stage sequence valves may be utilized to control the covers in the case that three or more chamber covers are provided.

Hydraulic system 138 further includes at least one double acting hydraulic gate cylinder 164 for rasing and lowering gate 136. Gate cylinder 164 is actuated and controlled by a gate control spool valve or gate valve 178. Gate valve 178 cannot extend gate cylinders 164 to open gate 136 unless chamber covers 108 are closed in the operating position. Thus, the safety of an operator is protected because feed chamber 98 is closed to pre-crusher 34 while chamber covers are open. Accordingly, the pre-grinding system according to the present invention minimizes risk of accidental operator contact with rotor assembly 44.

One aspect of the present invention to minimize risk to an operator is the sequential cycle of hydraulic system 138. Firstly, PVC and other materials are loaded into feed chamber 98 while chamber covers 108 are open in a loading position. Secondly, chamber covers 108 are lowered to a closed operating position with counterbalance valves 174 providing a dampening action of chamber covers 108 as they are lowered. Thirdly, once chamber covers 108 are closed, gate 136 is raised thus opening feed chamber 98 to the constantly rotating rotor assembly 44 of pre-crusher 34. Fourthly, once gate 136 is fully raised, feed cylinder 142 extends to longitudinally translate platen 104 through feed chamber 98 and push the PVC and other materials within feed chamber 98 toward and into pre-crusher 34. Fifthly, feed cylinder 142 retracts to its original starting position. Sixthly, gate 136 is lowered to a closed loading position thus closing pre-crusher 34 and rotor assembly 44 from feed chamber 98. Lastly, chamber covers 108 raise to their open loading position to allowing loading of more PVC and other materials into feed chamber 98 and repeating the process.

In FIGS. 1–12, similar reference numerals are used for similar parts corresponding to those previously mentioned followed by subscript a.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In a pre-grinding system for reducing scrap material to chips, said system having a pre-crusher for impact grinding the material, a feed chute for collecting the material for impact grinding, and a hydraulic cylinder section for transferring the material from said feed chute into said pre-crusher, an improvement comprising:

a feed chute trough;

a feed chute cover pivotally connected to said feed chute trough;

a hydraulic actuator for opening and closing said feed chute cover;

a counterbalance valve for dampening closure of said feed chute cover.

2. In a pre-grinding system for reducing scrap material to chips, said system comprising:

a pre-crusher for impact grinding the material;

a feed chute for collecting the material for impact grinding connected to said pre-crusher, said feed chute including a feed chamber, a cover for closing said feed chamber, said cover having an opened-loading position and a closed-operating position, and a gate providing access from said chamber into said pre-crusher, said gate having a closed-loading position and an opened-operating position;

a hydraulic feed cylinder section for transferring the material from said feed chute into said pre-crusher; and a control system for controlling said cover, said gate, and said hydraulic cylinder section, wherein said control system moves said gate from said closed-loading position to said opened-operating position only when said cover is in said closed-operating position.

3. The pre-grinding system in accordance with claim 2 above, wherein said control system comprises a hydraulic control system.

4. The pre-grinding system in accordance with claim 2 above, wherein said control system actuates said hydraulic feed cylinder only when said gate is in said opened-operating position.

5. In a pre-grinding system for reducing scrap material to chips, said system having a pre-crusher for impact grinding the material, a feed chute for collecting the material for impact grinding, and a hydraulic cylinder section for transferring the material from said feed chute into said pre-crusher, an improvement comprising:

a feed chute trough including a feed chamber, an opening providing access into said feed chamber, and a side wall having a recess extending downwardly from said opening;

a feed chute cover pivotally connected to said feed chute trough, said feed chute cover having an overhang having a shape corresponding to the shape of said recess, wherein said recess provides horizontal access into said feed chute for viewing into said feed chamber; and a hydraulic actuator for opening and closing said feed chute cover; and a counterbalance valve for dampening closure of said feed chute cover.

6. In a pre-grinding system for reducing scrap material to chips, said system having a pre-crusher for impact grinding the material, a feed chute for collecting the material for impact grinding, and a hydraulic cylinder section for transferring the material from said feed chute into said pre-crusher, wherein said feed chute is connected to said pre-crusher, and wherein said cover includes an opened-loading position and a closed-operating position, and wherein said feed chute includes a gate providing access from said chamber into said pre-crusher, said gate having a closed-loading position and an opened-operating position, said system comprising:

a feed chute trough including a feed chamber, an opening providing access into said feed chamber, and a side wall having a recess extending downwardly from said opening;

a feed chute cover pivotally connected to said feed chute trough, said feed chute cover having an overhang having a shape corresponding to the shape of said recess, wherein said recess provides horizontal access into said feed chute for viewing into said feed chamber;

a hydraulic feed cylinder section for transferring the material from said feed chute into said pre-crusher; and a control system for controlling said cover, said gate, and said hydraulic cylinder section, wherein said control system moves said gate from said closed-loading position to said opened-operating position only when said cover is in said closed-operating position.

7. The pre-grinding system in accordance with claim 6 above, wherein said control system comprises a hydraulic control system.

8. The pre-grinding system in accordance with claim 6 above, wherein said control system actuates said hydraulic feed cylinder only when said gate is in said opened-operating position.

* * * * *